US007311215B2

(12) United States Patent
Sommerfeld

(10) Patent No.: US 7,311,215 B2
(45) Date of Patent: Dec. 25, 2007

(54) POSITIONAL VARIABLE ORIFICE PIN FOR HYDRAULIC PRESSURE CONTROL IN A DRAFT GEAR

(75) Inventor: Howard Sommerfeld, Oak Forest, IL (US)

(73) Assignee: WABTEC Holding Corp., Wilmerding, PA (US)

( * ) Notice: Subject to any disclaimer, the term of this patent is extended or adjusted under 35 U.S.C. 154(b) by 307 days.

(21) Appl. No.: 11/201,894

(22) Filed: Aug. 11, 2005

(65) Prior Publication Data

US 2006/0043046 A1 Mar. 2, 2006

Related U.S. Application Data

(60) Provisional application No. 60/604,581, filed on Aug. 26, 2004.

(51) Int. Cl.
*B61G 9/00* (2006.01)

(52) U.S. Cl. ..... 213/32 C; 213/43; 213/24; 213/35; 213/41

(58) Field of Classification Search ..... 213/43, 213/22, 24, 31, 32 A, 32 R, 34, 35, 37, 38, 213/39, 40 R, 41, 44, 45, 32 C, 23
See application file for complete search history.

(56) References Cited

U.S. PATENT DOCUMENTS 3,368,698 A 2/1968 Cardwell
3,534,870 A 10/1970 Daugherty, Jr.
4,601,461 A 7/1986 Brough et al.
4,645,187 A 2/1987 Kanjo
5,152,409 A 10/1992 Sommerfeld
5,529,194 A 6/1996 Merker
6,446,820 B1 9/2002 Barker
6,488,162 B1 12/2002 Carlstedt
6,923,331 B2 * 8/2005 Sommerfeld ..... 213/32 C

FOREIGN PATENT DOCUMENTS

GB 866233 6/1959

* cited by examiner

*Primary Examiner*—Mark T. Le
(74) *Attorney, Agent, or Firm*—James Ray & Assoc.

(57) ABSTRACT

A draft gear assembly including a housing having an open front and closed rear portions. A compressible cushioning element is positioned within the rear portion with a seating arrangement abutting one end thereof adjacent the open front portion. A friction cushioning element is provided in the open front portion of the housing. A spring release mechanism continuously urges the friction cushioning element outwardly from the compressible cushioning element thereby releasing such friction cushioning element after compression of such draft gear assembly. A compressible cushioning element includes a hydraulic cylinder having a slidable piston to define a high pressure chamber and a low pressure chamber. A positional variable metering assembly is disposed within the piston to increase the reaction fluid pressure in the low pressure chamber for increasing the shock absorbing capacity of such draft gear assembly during operational buff conditions and to reduce the reaction fluid in the low pressure chamber pressure for meeting the requirements of the drop hammer test.

20 Claims, 2 Drawing Sheets

POSITIONAL VARIABLE ORIFICE PIN FOR HYDRAULIC PRESSURE CONTROL IN A DRAFT GEAR

CROSS-REFERENCE TO RELATED APPLICATIONS

This application is related to and claims priority from U.S. Provisional Patent Application Ser. No. 60/604,581 filed Aug. 26, 2004. This application is further related to the invention disclosed in U.S. Pat. No. 3,368,698 titled "Hydraulic Draft Gear with Constant Force Device", the invention disclosed in patent application Ser. No. 10/634,559 (U.S. Pat. No. 6,923,331) filed Aug. 5, 2003 titled "High Capacity Draft Gear", the invention disclosed in patent application Ser. No. 10/928,843 (U.S. Pat. No. 7,097,055) filed Aug. 27, 2004 titled "Long Buff Short Travel Draft Gear", the invention disclosed in patent application Ser. No. 10/927,910 (U.S. Pat. No. 7,175,036) filed Aug. 27, 2004 titled "Long Travel High Capacity Draft Gear", the invention disclosed in patent application Ser. No. 10/927,911 filed Aug. 27, 2004 titled "Housing for Long Travel High Capacity Draft Gear", the invention disclosed in patent application Ser. No. 11/008,011 filed Dec. 9, 2004 and titled "Housing for Long Travel High Capacity Draft Gear", and the invention disclosed in patent application Ser. No. 11/174,677 filed on Jul. 5, 2005 titled "Two Piece Draft Gear Housing with Integral Yoke", all owned by the assignee of the present invention. The teachings of U.S. Pat. No. 3,368,698 and patent application Ser. Nos. 10/634,559 (U.S. Pat. No. 6,923,331); 10/928,843 (U.S. Pat. No. 7,097,055); 10/927,910 (U.S. Pat. No. 7,175,036); 10/927,911; 11/008,011 and 11/174,677 are incorporated herein by reference thereto.

FIELD OF THE INVENTION

The present invention relates, in general, to draft gear assemblies for use in cushioning both buff and draft shocks normally encountered by railroad rolling stock during make-up and operation of a train consist on a track structure and, more particularly, this invention relates to a friction-type draft gear assembly utilizing a hydraulic compressible cushioning member offering higher protection to the railroad car and, yet more particularly, the instant invention relates to a positional variable orifice pin enabling control of the hydraulic fluid pressure to meet the requirements of the drop hammer test and operational conditions.

BACKGROUND OF THE INVENTION

Draft gears, widely used in railroad industry to provide protection to a railroad car by absorbing shocks in both draft and buff conditions, must meet various Association of American Railroads (AAR) requirements. The draft gear must be capable of maintaining the minimum shock absorbing capacity during its service life required by AAR standard M-901-E to be at least 36,000 foot pounds. Also the AAR mandates that working action of such draft gear is to be achieved without exceeding a 500,000 pound reaction pressure acting on the freight car sills in order to prevent upsetting the coupler shank. Further, the draft gear must pass a drop hammer test meeting the endurance portion of the AAR standard M-901-G, which determines the shock absorbing capacity of the draft gear.

The commonly used draft gears, installed horizontally in alignment with a railroad car center, include a housing having a front and a rear portion. A compressible cushioning element is positioned within the rear portion of the housing. A friction cushioning element is in the front portion of the housing adjacent the coupler of such railroad car. A spring release mechanism is provided for continuously urging the friction cushioning element outwardly from the compressible cushioning element to release such friction cushioning element after compression of such draft gears. The compressible cushioning element is typically either an all spring configuration or a spring and hydraulic assembly combination as taught in U.S. Pat. No. 3,368,698.

The draft gear employing a hydraulic assembly, enables a higher drop hammer capacity than an all spring design and is capable of a higher shock absorbing capacity.

patent application Ser. No. 10/634,559 teaches a draft gear with a shock absorbing capacity to be slightly higher than 100,000 foot pounds, capable of achieving a higher protection to the railroad car prior to the draft gear using all of its travel. A feature of this draft gear is related to the fixed size of the metering pin area and, more particularly, a fixed opening pressure of the hydraulic metering system which is not affected by the high fluid pressure side in combination with the spring force required to keep the valve in the closed position.

However, it was discovered, such draft gear did not meet the requirements of the drop hammer test due to such fixed size of the metering pin area. An attempt to modify the size of the metering pin area to meet drop hammer test requirements resulted in an acceptable performance on the test track simulating operational buff conditions. As it was further determined, the underlying cause is related to a difference in a speed of impact between a drop hammer test and operational buff condition application. Such speed differential caused variations in the hydraulic pressure resulting in performance variations between the drop hammer test and operational buff conditions.

U.S. Pat. Nos. 5,529,194; 5,152,409; and 4,645,187 all owned by the assignee of the present invention, teach various improvements of the friction cushioning element disposed in the front portion of the draft gear housing suitable for use with the hydraulic compressible cushioning element disposed in the rear portion of the housing.

U.S. Pat. No. 6,488,162 to Carlstedt teaches another embodiment of the friction cushioning element suitable for use with the hydraulic compressible cushioning element.

Additionally, U.S. Pat. No. 6,446,820 to Barker et al teaches a compressible resilient member, comprising an elastomer element, installed in a front portion of the draft gear adjacent the coupler shank and suitable for use with the hydraulic compressible cushioning element.

SUMMARY OF THE INVENTION

The present invention provides a draft gear assembly for railroad car stock having a higher shock absorbing capacity during operational buff conditions and meeting the requirements of the drop hammer test. The draft gear assembly comprises a housing at least partially closed at one end and open at the opposed end. The housing has a rear chamber adjacent the closed end and a front chamber adjacent the open end which is in open communication with such rear chamber. A hydraulic compressible cushioning element is centrally disposed within the rear chamber with one end thereof abutting at least a portion of an inner surface of the closed end of the housing and extending longitudinally from such one end. The hydraulic compressible cushioning element includes a spring and a hydraulic cylinder having a piston for establishing a low pressure chamber and a high pressure chamber. A flexible boot is fastened to the piston at one end and to the cylinder at the other end to prevent fluid leakage. A fluid communication means between the chambers and an orifice are provided within a head of the piston for equalizing and control of fluid pressure. A coil compression spring is disposed within an axial bore of the piston. A pin is disposed within a piston head cavity. A metering pin having a stem element with a working end is disposed within the axial bore and is biased by the compression coil spring against the pin in its fully released position. A raised step portion is provided adjacent the working end. A hydraulic compressible cushioning element positioning means is positioned adjacent such one end of the hydraulic compressible cushioning element and the inner surface of such closed end of the housing for maintaining such one end of the hydraulic compressible cushioning element centrally located in the rear chamber of the housing during compression and extension of such compressible cushioning element. A seat means, with at least a portion of one surface thereof abutting the opposite end of the hydraulic compressible cushioning element, is mounted to move longitudinally within the housing for respectively compressing and releasing the hydraulic compressible cushioning element during application and release of a force on the draft gear assembly. Also included is a positional variable metering assembly disposed within the piston for controlling the liquid pressure in the lower pressure chamber and therefore enabling compliance with a drop hammer test and operational buff conditions. The positional variable metering assembly includes a spring seat abutting the compression coil spring and having a pin aperture encasing the step portion of the metering pin and a plurality of metering apertures. A first flow control member is disposed adjacent the spring seat and includes a pin aperture and a plurality of control apertures having a first end in open communication with a respective metering aperture of the spring seat and a second end joined to such first end with a conical surface. A pin guide member has an aperture encasing the working end of the metering pin and has a concentrically disposed generally round surface engaging the aperture of the first flow control member for movement therein. Such pin guide member is equipped with a flange abutting a resilient means disposed within a spring cavity of the piston. A plurality of substantially spherical second flow control members, each disposed within the respective control aperture of the first flow control member, are provided for increasing the liquid pressure in the lower pressure chamber during the operational buff conditions with the draft gear assembly being disposed horizontally and decreasing the liquid pressure in the lower pressure chamber during the drop hammer test with the draft gear assembly being disposed vertically with the open end facing upwardly.

In one embodiment of the present invention, the housing has a pair of laterally spaced opposed friction surfaces located in the front chamber. A friction cushioning means is positioned, at least partially, within the front chamber of the housing for absorbing energy during application of a force sufficient to cause a compression of the draft gear assembly. The friction cushioning means includes a pair of laterally spaced stationary outer plates which have an outer friction surface engaging the laterally spaced friction surfaces carried by the housing. The pair of stationary outer plates have a Brinell hardness of between about 429 and 495. The outer friction surface includes at least one recessed area to reduce the frictional surface engaging area between the stationary outer plate and the laterally spaced friction surface carried by the housing, and at the same time decrease relative movement between such stationary outer plate and the housing. A pair of laterally spaced movable plates having at least a portion of an outer friction surface movably and frictionally engaging an inner friction surface of the stationary outer plate and one edge engaging the seat means. A pair of laterally spaced tapered stationary plates have an outer friction surface movably and frictionally engaging at least a portion of an inner friction surface of the movable plate. A pair of laterally spaced wedge shoes having at least a portion of an outer friction surface movably and frictionally engaging at least a portion of an inner friction surface of the tapered stationary plate and at least a portion of one edge engaging the seat means. The pair of wedge shoes have a predetermined tapered portion on at least a portion of an opposed edge thereof. A center wedge having a pair of matching predetermined tapered portions for engaging the tapered portion of the wedge shoe to initiate frictional engagement of the friction cushioning means and thereby absorb energy. A spring release means engaging and longitudinally extending between the seat means and the center wedge for continuously urging the friction cushioning means outwardly from the compressible cushioning means to release such friction cushioning element when an applied force compressing the draft gear is removed.

In another embodiment of the present invention, the front portion of the housing is formed with a yoke portion for attachment to a coupler shank.

In yet another embodiment, an elastomeric compressible element is installed in the front portion of the housing.

OBJECTS OF THE INVENTION

It is therefore one of the primary objects of the present invention is to provide a draft gear assembly which protects a railroad car by absorbing shocks in both draft and buff conditions.

A further object of the present invention is to provide a draft gear assembly having a higher shock absorbing capacity which exceeds existing AAR standards.

Another object of the present invention is to provide a draft gear assembly enabling control of the hydraulic fluid pressure in order to meet requirements of both drop hammer test and operational buff conditions.

An additional object of the present invention is to provide economical means of retrofitting existing draft gear to achieve a higher shock absorbing capacity and meet requirements of both drop hammer test and operational buff conditions.

These and various other objects and advantages of the present invention will become more apparent to those persons skilled in the relevant art from the following more detailed description, particularly, when such description is taken in conjunction with the attached drawings and the appended claims.

DESCRIPTION OF THE PREFERRED AND ALTERNATIVE EMBODIMENTS

Figure 1:
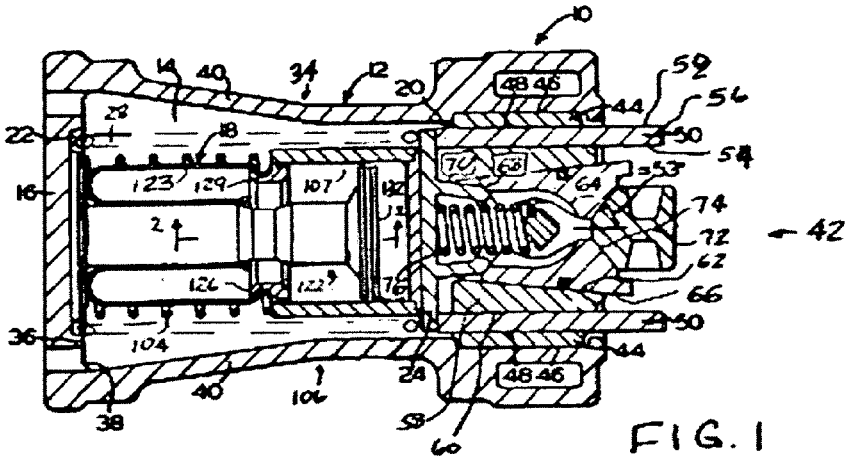
FIG. 1 is a longitudinal cross-sectional view of a draft gear of the present invention.

Prior to proceeding to the more detailed description of the present invention, it should be noted that for the sake of clarity, identical components having identical functions have been identified with identical reference numerals throughout the several views illustrated in the drawing figures.

The present invention enables a draft gear assembly containing a hydraulic compressible cushioning element to meet the requirements of the drop hammer test, wherein the draft gear is vertically disposed, and operational buff conditions, wherein the draft gear is horizontally disposed, by employing a positional variable metering assembly enabling enlargement of the metering area during the drop hammer test and reduction of the metering area during the operational buff conditions.

In reference to FIGS. 1-4, there is shown a presently preferred embodiment of a draft gear assembly, generally designated 10. The draft gear assembly 10 includes a housing 12, open at one end and having a rear portion 14 adjacent a bottom wall 16 which at least partially closes the other end of the housing 12. Rear portion 14 is adapted for receiving therein a compressible cushioning means 18. A front portion 20 of the housing 12 is maintained in open communication with the rear portion 14.

The compressible cushioning element 18 is centrally disposed within the rear portion 14 and has one end thereof abutting at least a portion of an inner surface 22 of the bottom wall 16 of housing 12. The compressible cushioning element 18 includes a hydraulic assembly 34, which includes at least one cylinder spring 104 and a hydraulic cylinder 106. The at least one cylinder spring 104 extending longitudinally from the bottom wall 16 is disposed intermediate such inner surface 22 and one end of the cylinder housing 107 of the hydraulic cylinder 106. A seat means 24 abutting an opposed end of cylinder housing 107 is adopted within the housing 12 for longitudinal movement therein for respectively compressing and releasing the compressible cushioning element 18 during application and release of a force on the draft gear assembly 10.

The compressible cushioning element 18 may further include at least one cushioning spring 28 disposed externally to the hydraulic assembly 34 and abutting a portion of the bottom wall 16 at one end and the seat means 24 at a distal end.

The housing 12 further includes a positioning means 36 disposed adjacent the inner surface 22 of the bottom wall 16 for maintaining that end of the compressible cushioning element 18 centrally located within the rear portion 14 of the housing 12 during compression and extension of such compressible cushioning element 18. The positioning means 36 includes a portion 38 of a predetermined thickness disposed in the housing 12 along two opposed sides adjacent inner surface 22 of the bottom wall 16 and an inner surface of a connecting sidewall 40 of housing 12. The positioning means 36 is preferably integral to the bottom wall 16.

In further reference to FIGS. 1-4, the hydraulic cylinder 106 includes a piston 122, equipped with a head 132 which is mounted within the cylinder housing 107 for reciprocal motion thereof. A flexible boot 123 having one end fastened to the piston 122 and having a second end fastened to a cap and boot adapter 126 of the cylinder 106. A rubber gasket 129 mounted within cap and boot adapter 126 seals the space between such adapter and the cylinder 106 to prevent leakage.

Figure 2:
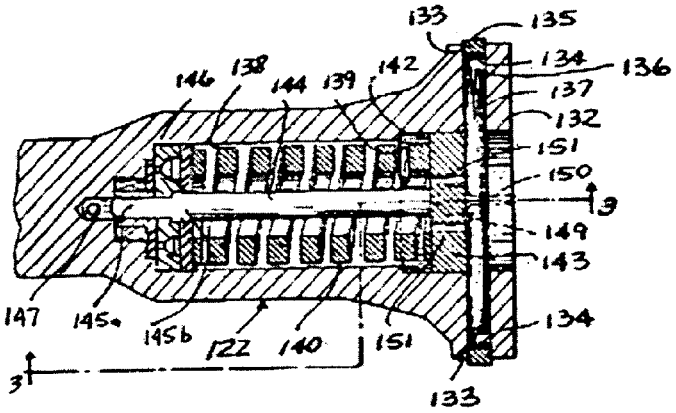
FIG. 2 is a partial axial cross-sectional view of the piston along lines 2-2 in FIG. 1, showing the piston of the hydraulic cushioning member.
Figure 3:
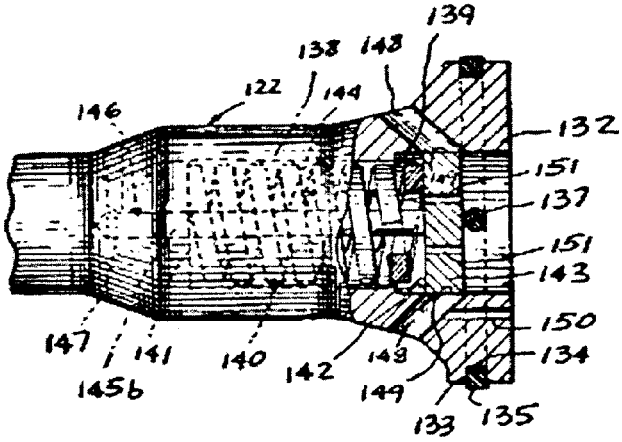
FIG. 3 is a partial axial cross-sectional view of the piston along the lines 3-3 in FIG. 2.

Now in reference to FIGS. 2-3, an expansion ring 134 and a piston ring 135 are mounted within an annular groove 133 formed within the piston head 132. A first cavity 136 coplanar with the groove 133 is adapted in the piston head 132 for receiving a pin 137 extending through the piston head 132 with ends adjacent the expansion ring 134.

A compression coil spring 140 of a first predetermined spring rate is disposed within an axial bore 138, which has a first predetermined diameter, of the piston 122 and is further disposed within an axial counterbore 139 abutting such axial bore 138. One end of the compression coil spring 140 is oriented towards the rear wall 141 of the bore 138 and the other end of the compression coil spring 140 abuts an inner surface 142 of a metering pin 143 which is slideably disposed within such counterbore 139. The metering pin 143 is biased by such compression coil spring 140 against the pin 137.

A stem element 144 attached to the inner surface 142 has a working end **145*a* of a predetermined length and a predetermined diameter, typically between 0.150 inches and 0.279 inches, and is preferably adapted with a step portion 145*b* of a predetermined diameter, preferably between 0.310 inches and 0.311 inches. Preferably, the step portion 145*b* is integral to the stem element 144. Alternatively, such step portion 145*b* can be a ring element 145*b* of a predetermined width rigidly secured to the stem element 144** by any attachment means, including but not limited to welding, soldering, brazing, and press fit.

The working end **145*a* slideably engages an axial cylinder guide 146 of a predetermined diameter, which is axially concentric with such axial bore 138 at such rear wall 141 thereof. A second cavity 147 bored generally perpendicular to such axial cylinder guide 146 connects the axial cylinder guide 146 with the outside of the piston 122 for relieving the pressure in the cylinder guide 146**.

The piston head 132 is adapted with at least one fluid passage 148 bored obliquely through the side walls of the piston for connecting the high pressure side of the cylinder 106 with the low pressure side of the cylinder 106 and piston 122. Preferably, a pair of fluid passages 148 are spaced diametrically opposite each other. Fluid passages 148 include an orifice 149 abutting such counterbore 139 and aligned to be almost, but not quite, completely closed when such metering pin 143 is in its outermost or released position, as best shown in FIGS. 2-3. The orifices 149 are slightly open to enable quick return of the metering pin 143 to its full released position and further enable a release of any residual pressure on piston 122. At least one restricted bore 150 is adapted from the face of the piston 132 to one of the fluid passages 148 for insuring a rapid return of the metering pin 143 to its full release position. At least one aperture 151 is provided in the metering pin 143 for equalizing the pressure on both sides of the piston 122. In the presently preferred embodiment there are six apertures 151 equally spaced about the longitudinal axis of metering pin 143.

In the presently preferred embodiment of the invention, a friction cushioning means, generally designated as 42, is disposed at least partially within the front portion 20 of the housing 12. The friction cushioning means 42 absorbs energy during application of a force sufficient to cause a compression of the draft gear assembly 10.

The friction cushioning means 42 includes a pair of laterally spaced outer stationary plates 44 having inner friction surface 48 and an opposed outer surface 46 engaging the housing 12.

Preferably, for optimum operation, the outer stationary plates have a Brinell hardness of between about 429 and 495 throughout.

A pair of laterally spaced movable plates 50 of substantially uniform thickness having an outer friction surface 52 and an inner friction surface 54 and at least one substantially flat edge 56 intermediate the outer friction surface 52 and an inner friction surface 54 is disposed within the open end of the draft gear assembly 10. The inner friction surface 54 has an edge 56 thereof engaging the seat means 24. At least a portion of the outer friction surface 52 movably and frictionally engages the inner friction surface 48 of the outer stationary plate 44.

A pair of laterally spaced tapered plates 58, having an outer friction surface 60 and an opposed inner friction surface 62, are positioned adjacent such movable plates 50. The outer friction surface 60 movably and frictionally engages at least a portion of the inner friction surface 54 of the movable plate 50.

The friction cushioning means 42 further includes a pair of laterally spaced wedge shoes 64 which have at least a portion of an outer friction surface 66 movably and frictionally engaging at least a portion of the inner friction surface 62 of the tapered stationary plate 58. Wedge shoes 64 have at least a portion of one edge 68 engaging seat means 24 and a predetermined tapered portion 70 on an opposed edge thereof.

A center wedge 72 having a pair of matching tapered portions 74 for engaging the tapered portion 70 of the wedge shoe 64 is provided to initiate frictional engagement of the friction cushioning means 42.

For optimum operation, the tapered portions 70 of the wedge shoes 64 and the tapered portions 74 of the center wedge 72 which are tapered upwardly and outwardly from a plane intersecting the longitudinal centerline of the draft gear assembly 10 must be controlled within a very close tolerance of about 53.0 degrees when such compressible cushioning element 18 includes the hydraulic assembly 34.

The draft gear assembly 10 additionally includes a spring release means 76 engaging and extending longitudinally between the seat means 24 and the center wedge 72 for continuously urging the friction cushioning mean 42 outwardly from the compressible cushioning means 18 to release the friction cushioning means 42 when an applied force compressing the draft gear assembly 10 is removed.

In operation, upon impact with a coupler (not shown), the buffing shock is transmitted from the coupler (not shown) through the front follower (not shown) to the central wedge 72, causing it to act through the wedge shoes 64 and thereby compress all of the cushioning elements simultaneously. These parts will furnish sufficient cushioning for light buffing shocks. After a suitable travel, however, the follower (not shown) will abut the outer ends of the movable plates 50 introducing energy-absorbing friction between the movable plates 50 and the stationary plates 58 and 44 which have been pressed together by the action of the wedge shoes 64. As this action continues, the pressure between the adjacent surfaces of the intercalated plates has been enormously increased due to the fact that the wedge shoes 64 are loaded against the cushioning mechanism 42. The energy absorption and dissipation through friction and compression of the cushioning mechanism continues until the gear is closed including compression of the compressible cushioning element 18.

Internal to compressible cushioning element 18, upon impact, movement of the friction cushioning mechanism 42 and the seat means 24 transmits fluid pressure in the high pressure side of the cylinder 106 to metering pin 143. Subsequently, the hydraulic fluid flows into the bore 138 through apertures 151, equalizing the fluid pressure on both sides of metering pin 143. However, because of the difference in the area between the inner and outer surfaces of the metering pin 143 due to the area occupied by the stem 144, the total force exerted on the outer surface is greater than the total force exerted on the inner surface 142. Such force differential results in an inward movement of the metering pin 143 against the resistance of the compression coil spring 140 thereby exposing orifices 149 and enabling the fluid to flow from the high pressure side of the cylinder 106 into the low pressure side of the cylinder 106 and piston 122.

As the velocity of the impact decreases and the draft gear assembly 10 starts to release, the pressure in the hydraulic cylinder 106 decreases accordingly, causing the metering pin 143 to move outwardly, due to resistance of the spring 140, and close orifices 149.

It will be apparent that each of the diameter of the working end 145*a* of the stem element 144 and the compression rate of the coil spring 140 has a direct effect on the resistive pressure in the low pressure side of the cylinder 106 and, more importantly, on the increased shock absorbing capacity of the draft gear assembly 10.

It will be apparent to those skilled in the art that since a velocity of impact during the drop hammer test is greater than a velocity of impact during operation buff conditions, different fluid pressure levels will be required to displace metering pin 143 and open orifices 149.

Accordingly, a positional variable metering means, generally designated 160, is provided within the piston 122 for controlling the fluid pressure and therefore enabling compliance of the draft gear assembly 10 with both the drop hammer test requirements and operational buff conditions.

Figure 4:
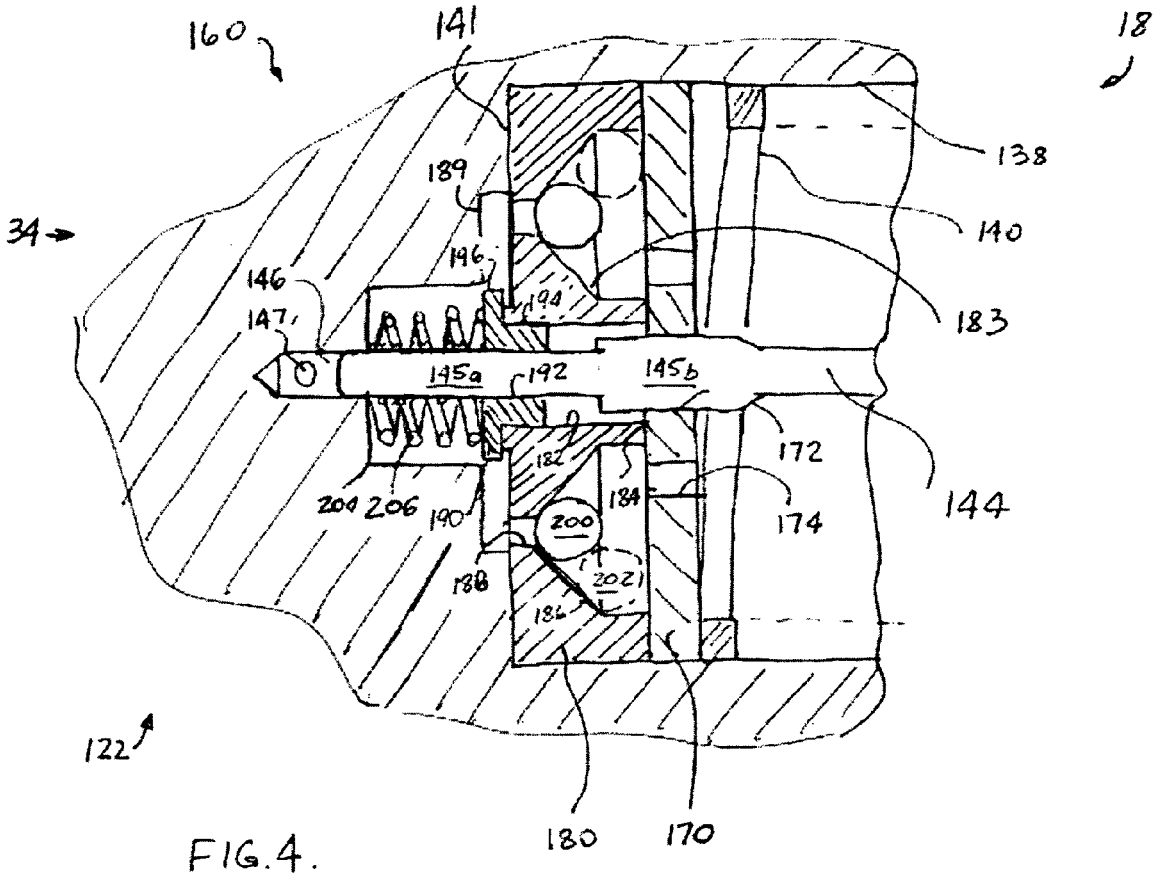
FIG. 4 is a partial axial cross-sectional view of the piston, showing a positional variable metering assembly of the present invention.

In the presently preferred embodiment, such positional variable metering means 160, best illustrated in FIG. 4, includes a spring seat 170 disposed within axial bore 138 and abutting the compression coil spring 140. The spring seat 170 has a pin aperture 172 of a predetermined diameter engaging the step portion 145*b* of the metering pin 143 and at least one metering aperture 174. Preferably, there are a plurality of metering apertures 174 disposed in a predetermined pattern within the spring seat 170. It is further preferred that there are six metering apertures 174 equally spaced about the longitudinal axis of such spring seat 170.

A first flow control member 180 is disposed intermediate the spring seat 170 and the rear wall 141 of the axial bore 138. Such first flow control member 180 includes an axially disposed aperture 182 and at least one control aperture 183 which has a first end 184 generally aligned and in open communication with the at least one metering aperture 174 and an opposed second end 188. The first and second ends 184 and 188 respectively are joined therebetween with a conical surface 186.

A second axial bore 189 is formed in the piston 122 in abutment with the rear wall 141 of the axial bore 138 and further in open communication with the second end 188 of the at least one control aperture 183.

A cavity 204 is formed in the piston 122 concentric with the cylinder axial guide 146 and in abutment with the second axial bore 189 for housing a resilient means 206, which preferably is a compression spring 206 having a second predetermined spring rate.

A pin guide member 190 has a concentrically disposed generally round surface portion 194 engaging the aperture 182 of the first flow control member 180 and is mounted for movement therein. The pin guide member 190 further has an aperture 192 closely encasing the working end 145*a* of the metering pin 143. Additionally, such pin guide member 190 may be adapted with a flange 196 for abutting such compression spring 206.

At least one second flow control member 200, being substantially a sphere in shape, is disposed within the at least one control aperture 183 for increasing the fluid pressure in the low pressure side during the operational buff conditions when the draft gear assembly 10 is disposed horizontally and decreasing the fluid pressure in such low pressure side during the drop hammer test when the draft gear assembly 10 is disposed substantially vertically with the open end 20 facing upwardly.

During the drop hammer test, when the draft gear 10 is disposed substantially vertically with the front portion 20 being oriented upwardly and the rear portion 14 being oriented downwardly, the at least one second flow control member 200 substantially abuts the second end 188 of the at least one control aperture 183 and portion of the conical surface 186. The at least one metering aperture 174 enables the high fluid pressure formed in the axial bore 139 to urge the at least one second flow control member 200 towards the second end 188, causing closure thereof, and, therefore, substantially prevent the fluid pressure flow therethrough.

Downward movement of the metering pin 143 displaces the fluid thereby increasing the fluid pressure in the low pressure side under the inner surface 142 of the metering pin 143. The fluid pressure in the low chamber side is controlled by the area of the step portion 145*b*. Since such area of the step portion 145*b* is larger than the area of the stem 144 or of the working end 145*a*, the force acting on the inner surface 142 of the metering pin 143 will be reduced, thus requiring a lower fluid pressure to displace metering pin 143 and enabling the draft gear assembly 10 to meet the requirements of the drop hammer test.

The fluid pressure formed between the step portion 145*b* and the end of the pin guide member 190 causes movement thereof against the force of the resilient means 206 and enables such fluid pressure to escape through the second cavity 147 bored generally perpendicular to such axial cylinder guide 146. As the draft gear assembly 10 starts to release, the resilient means 206 urges the pin guide member into abutment with the first flow control member 180.

When subjected to operational buff conditions, the draft gear 10 is horizontally disposed as shown in FIGS. 1-4. The at least one second flow control member 200 is disposed towards the first end 184 of the at least one control aperture 183, as best indicated by reference numeral 202 in FIG. 4, enabling fluid pressure flow through the second end 188 into the second axial bore 189 and then into the axial guide 146.

The fluid pressure in the low chamber side is now controlled by the area of the working end 145*a*. Since such area of the working end 145*a* is smaller than the area of the step portion 145*b*, the force acting on the inner surface 142 of the metering pin 143 will be increased thus requiring a higher pressure to displace metering pin 143 and enabling the draft gear assembly 10 to meet the requirements of the operational buff conditions.

Those skilled in the art will readily understand that retrofit of the existing draft gear assembly 10 will simply require a drilled extension of the axial bore 138 and axial cylinder guide 146 and addition of the drilled spring cavity 204 and the second axial bore 189 to enable installation of the positional variable metering means 160. The step portion 145*b* can be added to the metering pin 143 by any method described above or a new metering pin 143 incorporating such step portion 145*b* can be used. As described, existing draft gear 10 assembly can be retrofitted with the positional variable metering means 160 of the present invention to provide higher shock absorbing capabilities during operational buff conditions and meet the requirements of the drop hammer test.

While the step portion 145*b* increases shock absorbing capacity of the draft gear assembly 10, those skilled in the art will readily understand that the metering pin 143 having a stem element of uniform diameter throughout may be utilized with the positional variable metering means 160 of the present invention to provide compliance with both the drop hammer test requirements and operational buff conditions.

It will be apparent to those skilled in the art that in accordance with teachings of the related patent applications disclosed supra, the rear portion of the housing may include a pair of ledge members having a predetermined width and disposed intermediate the bottom wall and the front portion, each abutting a respective working surface of a pair of rear stops attached to a sill of a railroad rolling stock, whereby the pair of rear ledge members enables the at least partially closed end to extend into such sill intermediate such pair of rear stops past such working surfaces thereof.

The bottom wall of the rear portion may be removably attached or integral to the at least partially closed end of the rear portion.

Furthermore, the front portion may incorporate an integral yoke member provided with a pair of aligned coupler key apertures for attachment to a coupler shank of such railroad rolling stock.

As taught in U.S. Pat. No. 6,446,820 to Barker et al, a compressible resilient member, comprising a plurality of compressible elastomeric elements arranged in a stack, may be disposed within such yoke portion in place of a friction cushioning member of the presently preferred embodiment.

Additionally, in accordance with teachings of the related patent application Ser. No. 11/174,677 filed on Jul. 5, 2005 titled "Two Piece Draft Gear Housing with Integral Yoke", the rear portion and front portion may be formed as independent elements and joined together with fasteners.

Although a presently preferred and various alternative embodiments of the present invention have been described in considerable detail above with particular reference to the drawing FIGURES, it should be understood that various additional modifications and/or adaptations of the present invention can be made and/or envisioned by those persons skilled in the relevant art without departing from either the spirit of the instant invention or the scope of the appended claims.

I claim:

1. A draft gear assembly for absorbing buff and draft shocks encountered in railroad rolling stock, said draft gear assembly comprising:

(a) a housing having a closed end and an open end opposing said closed end, said housing further having a rear portion adjacent said closed end and a front portion adjacent said open end, said rear portion having a bottom wall and said front portion being in open communication with said rear portion;

(b) a compressible cushioning element centrally disposed within said rear portion with one end thereof abutting at least a portion of an inner surface of said bottom wall of said housing, said compressible cushioning element extending longitudinally from said one end and includes a hydraulic cylinder and at least one cylinder spring disposed intermediate said cylinder and said bottom wall, said hydraulic cylinder including:

(i) a cylinder housing, (ii) a piston having a piston head and an axial bore of a first predetermined diameter having a rear wall and an open end, an axial counterbore abutting said axial bore at said open end, an axial cylinder guide of a second predetermined diameter concentric with said axial bore, said axial cylinder guide abutting said axial bore at said rear wall end, said axial cylinder guide having a second cavity bored perpendicular to said cylinder guide for connecting it with an outside of said piston, said second cavity for further relieving a pressure in said axial cylinder guide, said piston slideably disposed within said cylinder housing to establish a high pressure chamber and a low pressure chamber, (iii) a flexible boot having one end fastened to said piston and having a second end fastened to a cap and boot adapter of said cylinder, (iv) a rubber gasket mounted within said cap and boot adapter for sealing a space between said cap and boot adapter and said cylinder to prevent leakage, (v) at least one fluid passage disposed within said piston for establishing a communication between said high pressure chamber and said low pressure chamber; said at least one fluid passage having a flow restricting orifice disposed at one end adjacent said axial counterbore of said piston, said flow restricting orifices exposed to said high pressure chamber, (vi) an expansion ring and a piston ring mounted within an annular groove formed within said piston head, (vii) a first cavity coplanar with said annular groove of said piston head, (viii) a pin disposed within said first cavity, said pin extending through said piston head, said pin having ends adjacent said expansion ring, (ix) a metering pin slideably disposed within said piston, said metering pin including an inner surface and an outer surface, a stem element attached to said inner surface and movable within said axial bore and said axial cylinder guide, said stem element having a working end of a predetermined length and a first predetermined diameter and a step portion of a second predetermined diameter disposed adjacent said working end, at least one aperture disposed within said metering pin for equalizing fluid pressure between said high pressure chamber and said low pressure chamber of said piston, said metering pin at least partially closing said flow restricting orifice when said metering pin is in its fully released position, (x) a restricted bore extending from a surface of said piston head to said at least one fluid passage for insuring a rapid return of said variable orifice metering pin to its full release position, (xi) a compression coil spring of a predetermined spring rate disposed within said axial bore of said piston having one end oriented towards said rear wall of said axial bore and having another end abutting said inner surface of said metering pin, said compression coil spring biasing said metering pin against said pin disposed within said first cavity, and (xii) a positional variable metering means disposed within said piston and operable in a first position for increasing a reaction fluid pressure in said low pressure chamber of said hydraulic cylinder causing an increased shock absorbing capacity of said draft gear assembly during operational buff conditions, said positional variable metering means operable in a second position for lowering said reaction fluid pressure in said low pressure chamber of said hydraulic cylinder for compliance with requirements of a drop hammer test;

(c) a positioning means on said inner surface of said closed end of said housing for maintaining said one end of said hydraulic compressible cushioning element centrally positioned in said rear portion of said housing during compression and extension of said hydraulic compressible cushioning element;

(d) a seat means having at least a portion of one surface thereof abutting the opposite end of said hydraulic compressible cushioning element and mounted to move longitudinally within said housing for assisting in releasing said draft gear assembly after an application of a force on said draft gear and during a release of a such force on said draft gear assembly;

(e) a friction cushioning means positioned at least partially within said front portion of said housing for absorbing energy during a compression of said draft gear assembly, said friction cushioning means including:

(i) a pair of laterally spaced outer stationary plates having an outer surface and an opposed inner friction surface, said outer surface engaging said housing, said pair of outer stationary plates having a Brinell hardness of between about 429 and 495 throughout, (ii) a pair of laterally spaced movable plates of substantially uniform thickness and having an outer friction surface and an inner friction surface and at least one substantially flat edge intermediate said outer and inner friction surfaces, said one edge engaging said seat means, at least a portion of said outer friction surface movably and frictionally engaging said inner friction surface of said outer stationary plate, (iii) a pair of laterally spaced tapered plates having an outer and an inner friction surface, said outer friction surface movably and frictionally engaging at least a portion of said inner friction surface of said movable plate, (iv) a pair of laterally spaced wedge shoes having at least a portion of an outer friction surface movably and frictionally engaging at least a portion of an inner friction surface of said tapered plate and at least a portion of one edge engaging said seat means, said pair of wedge shoes having a predetermined tapered portion which is tapered upwardly and outwardly from a plane intersecting a longitudinal center line of said draft gear assembly at an angle of about 53 degrees on an opposed edge thereof, and (v) a center wedge having a pair of matching tapered portions at an angle of about 53 degrees for engaging said tapered portion of said wedge shoe to initiate frictional engagement of said friction cushioning means and thereby absorb energy; and (f) a spring release means engaging and longitudinally extending between said seat means and said center wedge for continuously urging said friction cushioning means outwardly from said compressible cushioning means to release said friction cushioning element when an applied force compressing said draft gear is removed.

2. The draft gear assembly, according to claim 1, wherein said step portion is one of integral and rigidly attached to said stem element of said metering pin.

3. The draft gear assembly, according to claim 1, wherein a diameter of said step portion is greater than a diameter of said working end at least one of said metering pin and a diameter of said stem element of said metering pin.

4. The draft gear assembly, according to claim 1, wherein said positional variable metering means includes:

(a) a spring seat disposed within said axial bore and abutting an end of said compression coil spring which is oriented towards said rear wall of said axial bore, said spring seat having a first aperture of a predetermined diameter, axially disposed within said spring seat and encasing said step portion of said metering pin and at least one second aperture radially opposing said first aperture;

(b) a first flow control member disposed within said axial bore intermediate said spring seat and said rear wall of said axial bore, said first flow control member having an axially disposed aperture and at least one control aperture having a first end thereof generally aligned and being in open communication with said at least one second aperture of said spring seat, an opposed second end oriented towards said rear wall and a conical surface portion joining said first end and said second end;

(c) a second axial bore formed in said piston in abutment with said rear wall of said axial bore and in open communication with said second end of said at least one control aperture of said first flow control member;

(d) a cavity formed in said piston concentrically with a portion of said axial cylinder guide and in abutment with said second axial bore;

(e) a pin guide member mounted for movement within said axial aperture of said first flow control means and said cavity;

(f) a compressible resilient means disposed within said cavity and abutting a surface of said pin guide member, said compressible resilient means is compressible by said pin guide member during application of said fluid pressure when said draft gear assembly is subjected to said drop hammer test, said compressible resilient means extendable for urging said pin guide member for engagement with said first flow control member when said draft gear assembly starts to release; and (g) at least one second flow control member movable within said at least one control aperture of said first flow control element between said first end and said second end, whereby movement of said at least one second flow control member towards said first end increases said fluid pressure in said low pressure chamber during said operational buff conditions when said draft gear assembly is disposed substantially horizontally and movement of said at least one second flow control member towards said second end closes said second end to a flow of fluid pressure therethrough and decreases said fluid pressure in said low pressure chamber during said drop hammer test when said draft gear assembly is disposed substantially vertically with said open end facing upward.

5. The draft gear assembly, according to claim 4, wherein said draft gear assembly includes a predetermined plurality of apertures equally spaced about a longitudinal axis of said spring seat.

6. The draft gear assembly, according to claim 5, wherein said predetermined plurality of said apertures is six.

7. The draft gear assembly, according to claim 4, wherein said predetermined diameter of said spring seat and a diameter of said step portion form a predetermined clearance therebetween.

8. The draft gear assembly, according to claim 4, wherein said pin guide member includes a radially extending flange abutting said compressible resilient means.

9. The draft gear assembly, according to claim 4, wherein said resilient means is a compression spring having a predetermined spring rate.

10. The draft gear assembly, according to claim 4, wherein a shape of said at least one second flow control member is substantially a sphere.

11. A draft gear assembly for absorbing buff and draft shocks encountered in a railroad rolling stock, said draft gear assembly comprising:

(a) a housing having at least a partially closed end and an open end opposing said partially closed end, said housing further having a rear portion adjacent said at least partially closed end and a front portion adjacent said open end, said rear portion having a bottom wall, said front portion being in open communication with said rear portion;

(b) a first cushioning element centrally disposed within said rear portion with one end thereof abutting at least a portion of an inner surface of said at least partially closed end of said housing, said first cushioning element extending longitudinally from said one end, said first cushioning element comprising a hydraulic cylinder and at least one cylinder spring disposed intermediate said cylinder and said bottom wall, said hydraulic cylinder including:

(i) a cylinder housing, (ii) a piston having a piston head, said piston including an axial bore of a first predetermined diameter having a rear wall and an open end, an axial counterbore abutting said axial bore at said open end, an axial cylinder guide having a second predetermined diameter concentric with said axial bore, said axial cylinder guide abutting said axial bore at said rear wall, said axial cylinder guide having a second cavity bored generally perpendicular to said cylinder guide for connecting it with an outside of said piston, said second cavity relieving a pressure in said axial cylinder guide, said piston slideably disposed within said cylinder housing to establish a high pressure chamber and a low pressure chamber, (iii) a flexible boot having one end fastened to said piston and a second end fastened to a cap and boot adapter of said cylinder, (iv) a gasket mounted within said cap and boot adapter for sealing a space between said cap and boot adapter and said cylinder to prevent leakage, (v) at least one fluid passage disposed within said piston for establishing a communication between said high pressure chamber and said low pressure chamber, said at least one fluid passage having a flow restricting orifice disposed at one end adjacent said axial counterbore of said piston, said flow restricting orifice exposed to said high pressure chamber, (vi) an expansion ring and a piston ring mounted within an annular groove formed within said piston head, (vii) a first cavity coplanar with said annular groove of said piston head, (viii) a pin disposed within said first cavity, said pin extending through said piston head, said pin having ends adjacent said expansion ring, (ix) a metering pin slideably disposed within said piston, said metering pin including an inner and an outer surface, a stem element attached to said inner surface within said cylinder guide and having a working end of a predetermined length and a predetermined diameter, at least one aperture disposed within said metering pin for equalizing a fluid pressure between said high pressure chamber and said low pressure chamber of said piston, said metering pin at least partially closing said flow restricting orifice when said metering pin is in its fully released position, (x) a restricted bore extending from a surface of said piston head to said at least one fluid passage for insuring a rapid return of said variable orifice metering pin to its full release position, (xi) a compression coil spring having a predetermined spring rate disposed within said axial bore of said piston having one end oriented towards said rear wall of said axial bore and having another end abutting said inner surface of said metering pin, said compression coil spring biasing said metering pin against said pin disposed within said first cavity, and (xii) a positional variable metering means disposed within said piston and operable for increasing a reaction fluid pressure in said low pressure chamber of said hydraulic cylinder causing an increased shock absorbing capacity of said draft gear assembly during operational buff conditions, said positional variable metering means operable for lowering said reaction fluid pressure in said low pressure chamber of said hydraulic cylinder for compliance with requirements of a drop hammer test;

(c) a positioning means on said inner surface of said at least partially closed end of said housing for maintaining said one end of said first cushioning element centrally positioned in said rear portion of said housing during compression and extension of said hydraulic compressible cushioning element;

(d) a seat means having at least a portion of one surface thereof abutting an opposite end of said first cushioning element and mounted to move longitudinally within said housing for respectively compressing and releasing said first cushioning element during application and release of a force on said draft gear assembly;

(e) a second cushioning means positioned at least partially within said front portion of said housing for absorbing energy during a compression of said draft gear assembly.

12. The draft gear assembly, according to claim 11, wherein said second cushioning means includes:

(a) a pair of laterally spaced outer stationary plates having an outer surface and an opposed inner friction surface, said outer surface engaging said housing;

(b) a pair of laterally spaced movable plates of substantially uniform thickness and having an outer friction surface and an inner friction surface and at least one substantially flat edge intermediate said outer and inner friction surfaces, said one edge engaging said seat means, at least a portion of said outer friction surface movably and frictionally engaging said inner friction surface of said outer stationary plate;

(c) a pair of laterally spaced tapered plates having an outer and an inner friction surface, said outer friction surface movably and frictionally engaging at least a portion of said inner friction surface of said movable plate;

(d) a pair of laterally spaced wedge shoes having at least a portion of an outer friction surface movably and frictionally engaging at least a portion of an inner friction surface of said tapered plate, and at least a portion of one edge engaging said seat means, said pair of wedge shoes having a predetermined tapered portion which is tapered upwardly and outwardly from a plane intersecting a longitudinal center line of said draft gear assembly at a first predetermined angle on an opposed edge thereof; and (e) a center wedge having a pair of matching predetermined tapered portions at a second predetermined angle for engaging said tapered portion of said wedge shoe to initiate frictional engagement of said second cushioning means and thereby absorb energy.

13. The draft gear assembly, according to claim 12, wherein said second cushioning means further includes a spring release means engaging and longitudinally extending between said seat means and said center wedge for continuously urging said second cushioning means outwardly from said first cushioning means to release said second cushioning element when an applied force compressing said draft gear is removed.

14. The draft gear assembly, according to claim 11, wherein said bottom wall of said rear portion is one of removably attached and integral with said at least partially closed end.

15. The draft gear assembly, according to claim 11, wherein said rear portion includes a pair of ledge members having a predetermined width and disposed intermediate said bottom wall and said front portion, each abutting a respective working surface of a pair of rear stops attached to a sill of such railroad rolling stock, whereby said pair of rear ledge members enables said at least partially closed end to extend into such sill intermediate such pair of rear stops past such working surfaces thereof.

16. The draft gear assembly, according to claim 11, wherein said draft gear assembly includes means engageable with said rear portion and said front portion for removably attaching said rear portion to said front portion.

17. The draft gear assembly, according to claim 11, wherein said draft gear assembly further includes means disposed within said front portion adjacent said open end for attaching said housing to a coupler of such railroad rolling stock.

18. The draft gear assembly, according to claim 17, wherein said means for attaching said housing to such coupler includes a pair of aligned coupler key apertures.

19. The draft gear assembly, according to claim 17, wherein said draft gear assembly further includes a coupler follower disposed in said front portion intermediate said second cushioning means and a coupler shank.

20. The draft gear assembly, according to claim 11, wherein said second cushioning element includes a predetermined plurality of elastomeric resilient members arranged in a stack.

* * * * *